United States Patent [19]

Tarr

[11] 4,445,826

[45] May 1, 1984

[54] PERISTALTIC PUMP APPARATUS

[75] Inventor: Fred P. Tarr, Lexington, Mass.

[73] Assignee: Polaroid Corporation, Cambridge, Mass.

[21] Appl. No.: 341,912

[22] Filed: Jan. 22, 1982

[51] Int. Cl.[3] ..... F04B 43/12

[52] U.S. Cl. ..... 417/476; 417/512; 417/517

[58] Field of Search ..... 417/474–477, 417/512, 517, 519

[56] References Cited

U.S. PATENT DOCUMENTS

| | | | |
|---|---|---|---|
| 12,753 | 4/1855 | Porter et al. . | |
| 173,215 | 2/1876 | Doremus . | |
| 813,443 | 2/1906 | Mikorey . | |
| 952,440 | 3/1910 | Dalzell | 417/519 X |
| 2,612,451 | 9/1952 | Land | 95/8 |
| 2,668,637 | 2/1954 | Gilmore | 222/95 |
| 2,866,340 | 12/1958 | Goldberg | 73/425.6 |
| 2,885,967 | 5/1959 | Vogel et al. | 103/149 |
| 2,960,868 | 11/1960 | Price | 73/425.6 |
| 3,151,616 | 10/1964 | Selfon | 128/214 |
| 3,186,324 | 5/1965 | Eloranta | 95/89 |
| 3,198,385 | 8/1965 | Maxwell | 222/41 |
| 3,327,898 | 6/1967 | Farr | 222/1 |
| 3,425,415 | 2/1969 | Gordon et al. | 128/214 |
| 3,496,878 | 2/1970 | Hargest et al. | 103/152 |
| 3,527,220 | 9/1970 | Summers | 128/260 |
| 3,604,418 | 9/1971 | Jones | 128/214 |
| 3,674,383 | 7/1972 | Iles | 417/476 |
| 3,852,781 | 12/1974 | Erlichman | 354/86 |
| 3,877,609 | 4/1975 | Cullis | 222/1 |
| 3,972,649 | 8/1976 | Jutte | 417/53 |
| 4,014,318 | 3/1977 | Dockum et al. | 128/1 D |
| 4,054,231 | 10/1977 | Eloranta | 222/102 |
| 4,187,057 | 2/1980 | Xanthopoulos | 417/477 X |
| 4,199,307 | 4/1980 | Jassawalla | 417/474 |
| 4,218,197 | 8/1980 | Meyer et al. | 417/477 X |
| 4,252,447 | 2/1981 | Borodin | 366/349 |
| 4,271,987 | 6/1981 | Eriksson et al. | 222/160 |

FOREIGN PATENT DOCUMENTS

| | | | |
|---|---|---|---|
| 310020 | 7/1933 | Italy | 417/476 |
| 1746 | of 1854 | United Kingdom . | |
| 502070 | 3/1939 | United Kingdom | 417/476 |

*Primary Examiner*—Richard E. Gluck
*Attorney, Agent, or Firm*—Edward S. Roman

[57] ABSTRACT

A peristaltic pumping system in which a length of elastic tubing connected at opposite ends to storage spools is advanced alternately in opposite directions through a pinch roll pair and in which opposite ends of the elastic tubing are connected in fluid communication alternately with pump intake and pump discharge conduits by a reversing valve. The valve is adjusted by means dependent on the direction of tubing travel through the pinch roll pair. The system is preferably incorporated in a cassette-like enclosure which may be removable received in a drive console. Alternately, the system may be self-contained in an enclosure adapted to be implanted in an animal body.

17 Claims, 11 Drawing Figures

PERISTALTIC PUMP APPARATUS

BACKGROUND OF THE INVENTION

1. Field of the Invention

This invention relates to improvements in fluid pumping apparatus and, more particularly, it concerns a peristaltic pump system which is adaptable to a wide range of applications in which reliably accurate rates of fluid delivery are required over extended periods of time.

2. Description of the Prior Art

Peristaltic pumps are well known and may be characterized generally as that class of fluid pumps in which a fluid pressure differential is created by alternately compressing and expanding an elastic tube. Typically, peristaltic pumps include a continuous length of tubing extending between an intake end at a source or supply of fluid and a discharge end in fluid communication with the point to which fluid is to be pumped. The pumping pressure differential resulting in movement of fluid through the elastic tube is brought about by progressively pinching the tube either by means such as a pinch roller movable relative to the tube while it is fixed against movement or by advancing the tube through a fixed nip defined by a pinch roller pair, for example. In either case, pressure is developed in the tube in advance of the progressive point of pinching and suction results in the tubing behind the same point as a result of the tubing returning to an expanded condition under the elastic memory of the material from which it is formed.

Because most pumping systems transfer fluids between fixed points of fluid supply and fluid discharge, peristaltic pumps most commonly employ a fixed length of elastic tubing and one or more compression rollers driven in orbital fashion to traverse an arcuate segment of the tubing. The disclosure of U.S. Pat. Nos. 3,527,220; 3,674,383 and 3,972,649 are representative of this type of peristaltic pump. As is apparent from the disclosure of the first two of these patents, a principal advantage of this type of peristaltic pump is that the entire flow path from the intake to the discharge end of the tubing is constituted exclusively by the tubing itself, thus eliminating any need for fittings, joints and other such hardware. Two basic problems, however, are presented by the fixed tubing of such pumps. In the first place, the requirement for the pressure developing roller to be driven in orbital fashion contributes to difficulties in maintaining an accurately constant rate of movement in the compression roller. Secondly, the same length of tubing is continuously contracted and expanded with the result that the effective life of the pump is limited by the continued ability of the tubing to expand under the elastic memory of the material from which it is formed. This latter problem is addressed in the disclosure of the third of the above-cited patents (U.S. Pat. No. 3,972,649) where a coiled supply of the tubing is provided to allow for the compressing pumping action to take place along the length of the tubing. The overall simplicity of the basic pump class, however, is compromised by the relatively complicated additional hardware required.

U.S. Pat. Nos. 2,960,868 and 3,327,898 are representative of a different type of peristaltic pump in which the tubing is moved relative to the nip of a fixed pinch roller. The earlier of these two patents relates to a pipette pump in which extremely small quantities of fluid are handled and which relies on movement of the tubing from a loop having one end fixed. The latter of the two patents discloses a similar apparatus in which the tubing constitutes the sole supply of fluid pumped. In this instance, the tubing is supplied as convolutions on a spool rotated relative to a fixed pinch roller. The pinch roller traverses the serveral convolutions of the tubing to discharge only fluid contained in the tubing. It is apparent that while the pumps disclosed in both of these latter patents are capable of very accurate pumping rates, neither is intended for operation without interruption over extended periods of time.

The cited U.S. Pat. No. 3,527,220, as well as U.S. Pat. No. 3,496,878 are further representative of pumping systems designed to be implanted in an animal body for the administration of drugs. Peristaltic pumps are especially suited to this particular application out of such inherent characteristics as facility for sterilization, predictability of pumping capacity by selection of the tubing size, overall simplicity, and facility for incorporation in a relatively small package. On the other hand, the application, in itself, demonstrates an acute need for reliability of operation over extended periods of time, capability for accurate control of pumping rates, and adaptability to severe packaging constraints.

SUMMARY OF THE PRESENT INVENTION

In accordance with the present invention, a peristaltic pump system is provided by which an elastic tube of a length restricted only by the spatial requirements for storage of the tube in coil form, is advanced for substantially its full length through the nip of a fixed pinch roll pair alternately in opposite directions, the opposite ends of the tube in turn serving alternately as pump intake and pump discharge ends by operation of a reversible valve actuated in response to the rotational direction of the pinch rollers. The tube preferably extends between a pair of rotatable spools having rotary seal couplings for fluid communication with the reversible valve. Pumping movement of the tube between the spools is effected by a motor drive connection to one of a pair of pinch rollers situated between the spools so that the one roller acts in the manner of a capstan whereas the other of the rollers acts in the manner of an idler anvil roller. Also, the idling roller is preferably connected directly but yieldably to the valve so that reversal in the rotational direction of the idler automatically reverses the condition of the valve and correspondingly, the connection of the respective spools with fluid supply and pump discharge.

The pump structure is especially suited for incorporation in a cassette-like housing which may be adapted for operation with an external drive console. Alternatively, it may be enclosed complete with a drive motor and control circuitry in a housing designed to be implanted in an animal body, for example. In either case, the pump structure may be enclosed with a supply of fluid to be pumped or it may be connected with an external supply of the same fluid.

A principal object of the present invention is, therefore, the provision of an improved peristaltic pump system which is extremely versatile in its adaptation to various pumping applications where accuracy of pumping rates and reliability of operation over extended periods of time are required. Other objects and further scope of applicability of the present invention will become apparent from the detailed description to follow taken in conjunction with the accompanying drawings in which like parts are designated by like reference numerals.

DETAILED DESCRIPTION OF THE PREFERRED EMBODIMENTS

Figure 1:
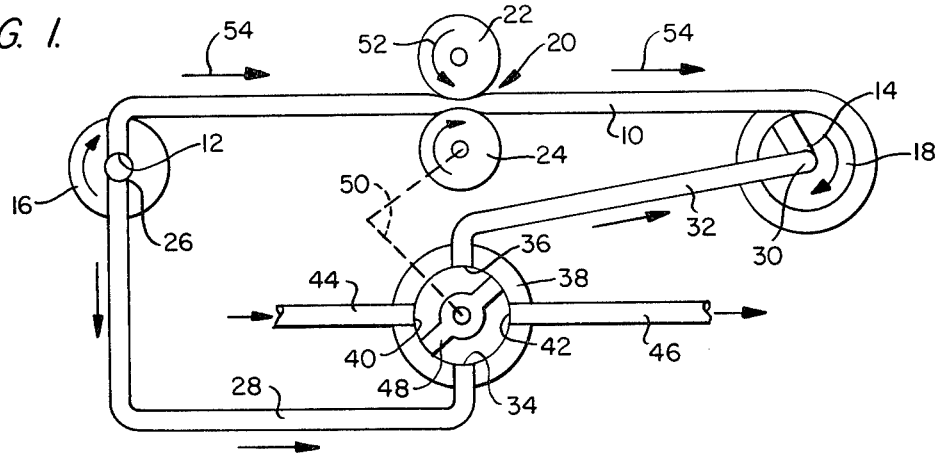
FIG. 1 is a schematic diagram illustrating the basic pumping components of the present invention in one condition or mode of operation.
Figure 2:
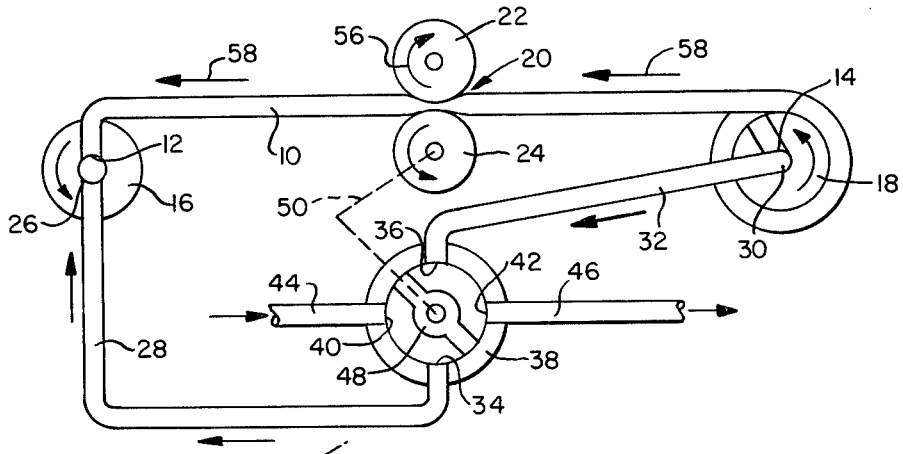
FIG. 2 is a similar view but illustrating the components in an alternative mode of operation.

In FIGS. 1 and 2 of the drawings, basic operating components of the present invention are shown schematically to include an elongated pumping tube 10 connected at opposite ends 12 and 14 to rotatable spool hubs 16 and 18, respectively. The run of the tubing 10 between the opposite ends 12 and 14 passes a nip defined by a pinch roller pair generally designated by the reference numeral 20. As will be described in more detail below, one of the pair of rollers 20 is a drive capstan 22 while the other roller 24 functions as an idling anvil. The end 12 of the pumping tube 10 is in fluid communication through the spool hub 16 with one end 26 of a fixed fluid conduit or tube 28. The end 14 of the pumping tube is similarly in fluid communication through the hub 18 with one end 30 of a second fixed fluid conduit or tube 32.

The tubes 28 and 32 terminate at their opposite ends 34 and 36, respectively, on diametrically opposite sides of a cylindrical valve housing 38. Also communicating with the interior of the valve housing 38 at diametrically opposite ends 40 and 42 displaced 90° from the tubing ends 34 and 36 are system intake and discharge conduits or tubes 44 and 46, respectively. A valve body or vane 48 is rotatably carried within the valve housing 38 for movement between the alternative positions shown in FIGS. 1 and 2. Preferably, the valve body is coupled by means to be described in more detail below but represented by the dashed line 50 in FIGS. 1 and 2 to the idling anvil roller 24.

From the schematic illustration of the basic components illustrated in FIGS. 1 and 2, the operation of the pumping system may be understood. In FIG. 1, assuming the capstan 22 to be driven in a counterclockwise direction of rotation as represented by the arrow 52, and assuming further that the spool hubs 16 and 18 are rotated to take up any slack in the pumping tube 10, the latter will be advanced in the direction of the arrows 54 from the hub 16 to the hub 18. The resulting rotation of the idler roll 24 will position the valve body 48 as shown in FIG. 1 to effect fluid communication from the pump intake 44 through the tube 32 with the end 14 of the pumping tube 10. Simultaneously, the pump discharge tube 46 will be in communication with the end 12 of the tube 10 through the tube 28. As the tube 10 advances through the pinch roller pair 20, fluid contained therein in advance of the pinch roller pair 20, being blocked from passage with the tube 10 past the nip of the rollers, will be discharged at the end 12 thereof through the tubing 28 and valve housing 38 to the discharge tube 46. As the tube 10 expands upon passing the pinch roller pair 20, internal negative pressure develops in the tube 10 to draw inwardly from the end 14, the tube 32 and the valve housing 38, fluid in communication with the intake tube 44.

When the supply of the pumping tube 10 wound on the spool hub 16 in the example depicted by FIG. 1 and the preceding paragraph is depleted, the rotational direction of the drive capstan 22 is reversed as represented by the arrow 56 in FIG. 2. The resulting reversal in the rotational direction of the idling anvil roller 24 shifts the valve body 48 to the position shown in FIG. 2 so that communication of the intake tube 44 and discharge tube 46 with the respective ends 12 and 14 of the tubing 10 is reversed. Thus, fluid at the intake tube is passed through the valve housing 38 and the fixed tube 28 to the end 12 of the pumping tube 10 whereas discharge from the pumping tube 10 as a result of travel through the pinch roll pair 20 in the direction of the arrows 58 (FIG. 2) causes pumping tube contained fluid to be discharged from the end 14, the tube 32, the valve housing 38 and the discharge tube 46.

In FIGS. 3–8 of the drawings, the pumping system described generally with reference to FIGS. 1 and 2 is shown as an embodiment in which the several fluid handling components are enclosed by a cassette-like housing 60 adapted to be removably mounted in a driving control console 62, all in a manner resembling an audio cassette and tape deck. Components previously designated by reference numerals in FIGS. 1 and 2 are designated by the same reference numerals in FIGS. 3–8.

Although the structure of the cassette 60 will be described in more detail with reference to FIGS. 4–8, it will be observed in FIG. 3 that the control console 62 is formed with a cassette receiving well 64 shaped to complement the exterior configuration of the cassette and having a generally planar floor 66. In addition to a pair of reversible drive spindles 68 and 70, positioned in the floor to cooperate with the spool hubs 16 and 18 in a manner to be described below, the capstan roller 22 is arranged to project from the cassette well floor 66 and be movable in an arcuate path, for example, between an active or working position as shown in solid lines in FIG. 3 and an inactive or retracted position as shown in phantom lines. Although not shown in the drawings, it will appreciated that the console 62 will include appropriate internal drive trains for the capstan 22 and the sprockets 68 and 70 and also that the console will be equipped with appropriate controls by which the direction of capstan and spindle rotation may be reversed and the speed thereof controlled accurately under the existing state-of-the-art relating to such apparatus.

Figure 3:
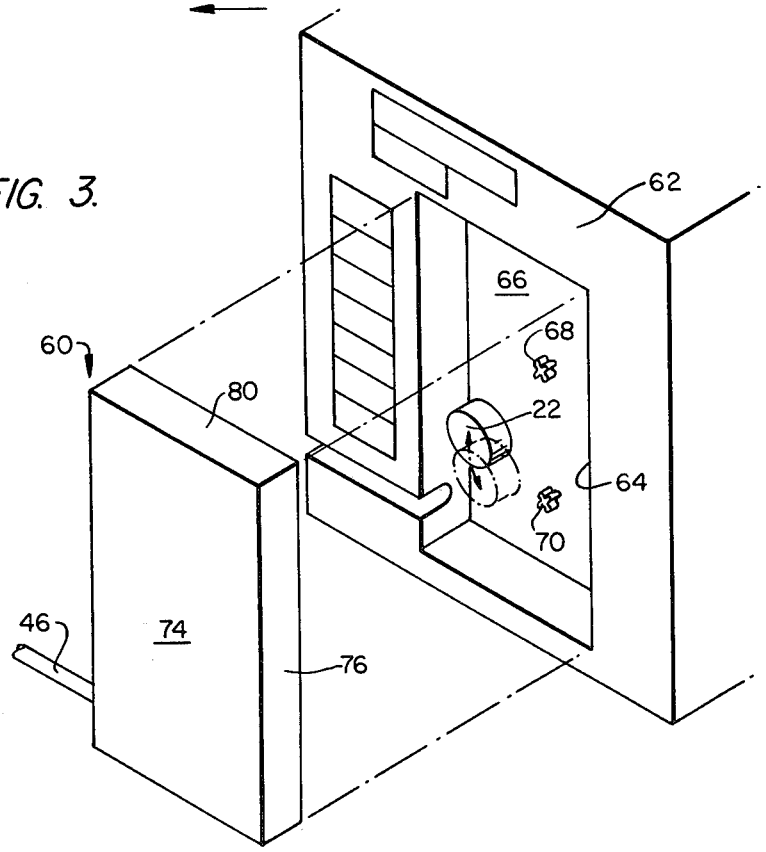
FIG. 3 is a fragmentary exploded perspective view illustrating the relationship of a cassette form of the present invention adapted for operation with a fixed drive console.
Figure 5:
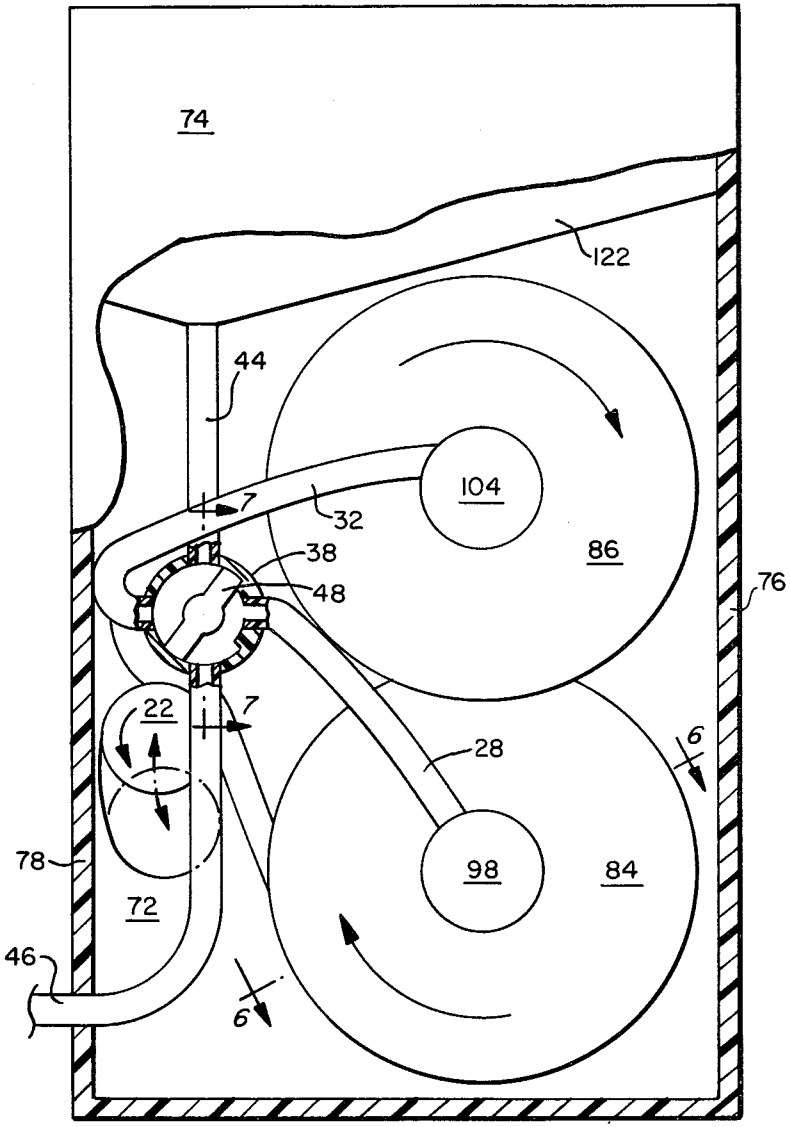
FIG. 5 is a view similar to FIG. 5 but at a parallel and displaced cutting plane.
Figure 4:
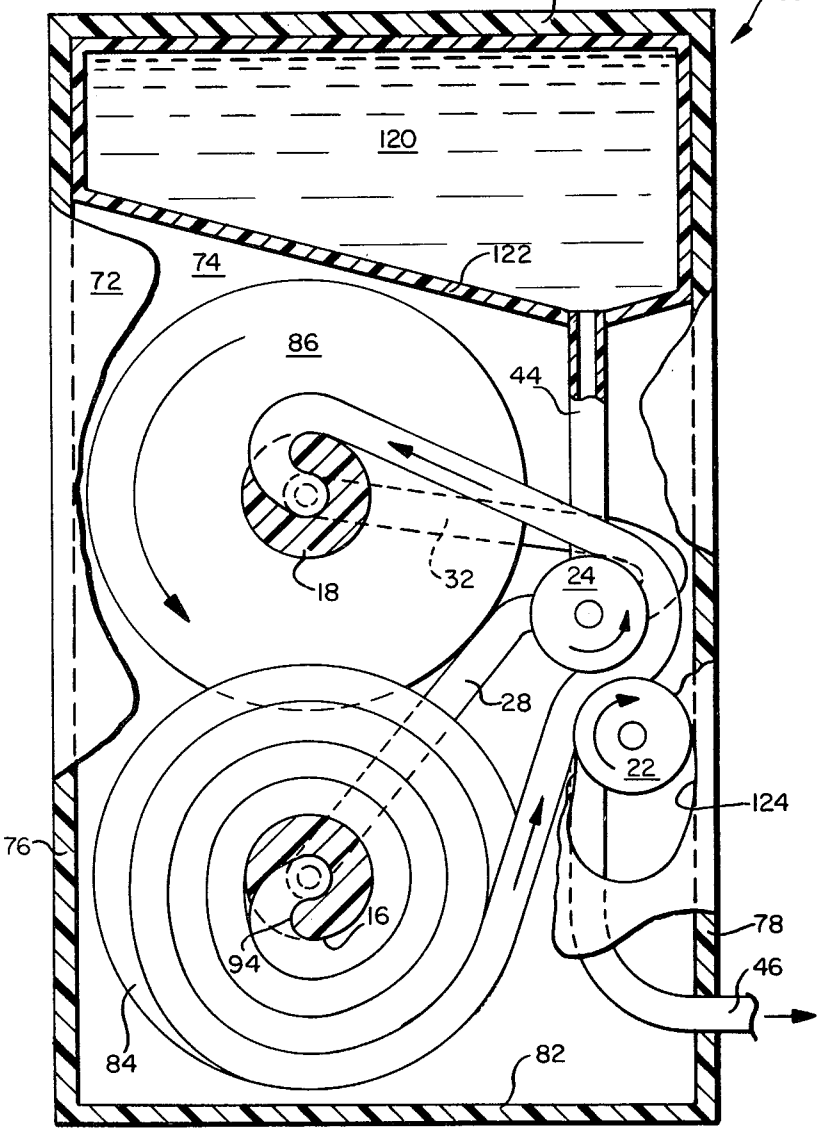
FIG. 4 is an enlarged fragmentary cross-section through a central plane of a cassette incorporating the invention.

The cassette 60, as shown in FIGS. 3–5 is of a configuration resembling a rectangular parallelepiped and as such includes front and back rectangular walls 72 and 74, respectively, joined peripherally by side walls 76 and 78 and top and bottom or end walls 80 and 82, respectively. Within the enclosure defined by such walls, the hubs 16 and 18 are rotatably supported between the front and back walls 72 and 74 and equipped with circular spool flanges 84 and 86, respectively. The pumping tube 10 is illustrated as being initially supplied in coiled convolutions on the spool hub 16 whereas the hub 18 would function initially as a take-up spool though these functions of the spools are reversible as above indicated. The construction of the hub 16 and its associated spool flanges 84 is illustrated most clearly in FIG. 6 and is identical to the construction of the spool hub 18 and its associated flange 86. In the illustrated embodiment, it will be noted that the hub 16 includes a journal boss 68 supported rotatably in a bearing aperture 90 provided in the front wall 72 of the cassette housing. A splined aperture 92 opens to the exterior of the cassette for engagement by the spindle 70 in the console 62.

Figure 6:
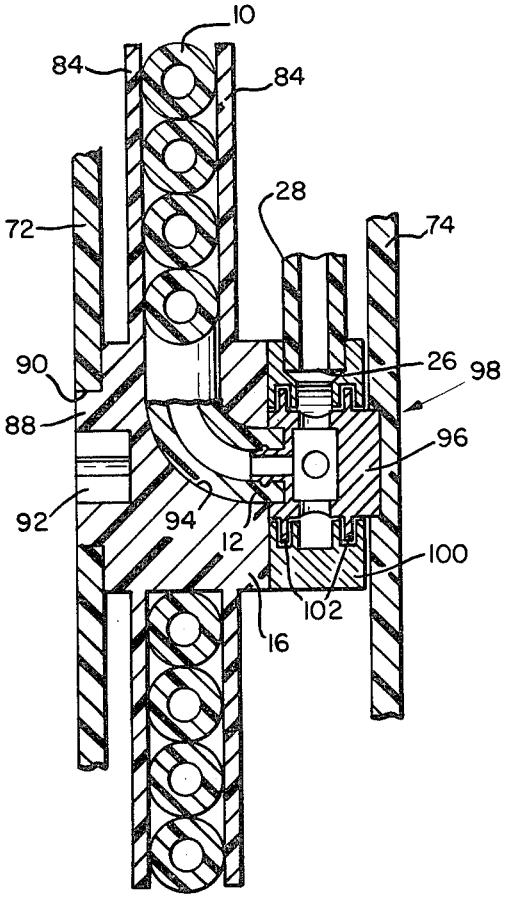
FIG. 6 is an enlarged fragmentary cross-section on line 6—6 of FIG. 5.

The spool hub structure by which opposite ends 12 and 14 of the pumping tube 10 are connected to be in fluid communication with the conduits 28 and 32 may be understood by reference to FIGS. 4 and 6. As shown in these drawing figures, the end 12 of the pumping tube 10 extends initially through a convolute passage 94 in the hub 16 which opens centrally and axially of the hub so that the tube end 12 may be joined with a rotor 96 of a rotary seal assembly 98. The assembly 98 includes a stator 100 equipped with appropriate seals such as labryinth seals 102 by which fluid communication between the rotor 96 and the stator 100 may occur without leakage. The end 26 of the tube 28 is in fluid communication with the stator 100 so that as a result of the illustrated manifolding and porting in the assembly 98, continuous fluid communication is established between the pump tube 10 and the fixed tube 28. An identical rotary seal assembly 104 functions to establish communication between the opposite end 14 of the pumping tube 10 with the fixed tube 32.

Figure 7:
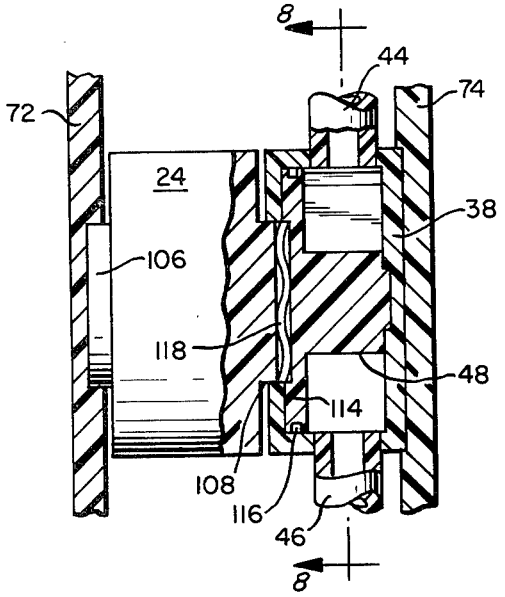
FIG. 7 is an enlarged fragmentary cross-section on line 7—7 of FIG. 5.
Figure 8:
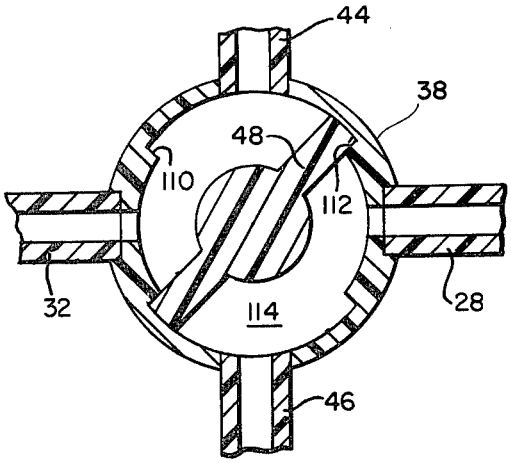
FIG. 8 is a cross-section on line 8—8 of FIG. 7.

An illustrative structural embodiment of the means 50 by which the idling anvil roller 24 and the valve body 48 are interrelated as well as more details of the valve housing 38 and valve body 48 are shown in FIGS. 7 and 8 of the drawings. In particular, the valve housing 38 is secured in fixed relationship to the rear wall 74 of the cassette housing 60 to be in axial alignment with the idling anvil roller 24. The roller 24 is rotatably supported by shaft extensions 106 and 108 journalled respectively in the front wall 72 and in the valve housing 38. The valve body 48 is rotatably supported within the housing 38 for limited movement between abutment stops 110 and 112 (FIG. 8). Also the end of the valve body 48 is defined as a circular disc 114 having a peripheral rotary seal 116 with respect to the interior of the valve housing 38. A resilient corrugated friction washer 118 is disposed between the end of the shaft extension 108 and the valve body disc 114 so that the valve body 48 will move with the roller 24 in the absence of an obstruction to valve body movement. Because of the obstruction to such movement provided by the stops 110 and 112, it will be appreciated that on reversal of the direction of rotation of the roller 24, the valve body 48 will be shifted until movement thereof is prevented by either one of the stops 110 and 112. Also upon continued rotation of the roller 24 in the same direction, the valve body will be retained against one or the other of the stops 110 and 112 yieldably without impeding continued rotation of the roller 24.

In the illustrated embodiment, the cassette 60 is shown to include a supply of fluid 120 suitably vented in a well-known manner to be discharged by operation of the pumping system. In particular and as shown in FIGS. 4 and 5, the fluid is contained by an internal reservoir 122 nestably enclosed by the upper end of the cassette 60. The pump intake tube 44 extends from the reservoir 122 to the valve as may be seen in either of FIGS. 4 and 5. While the storage of fluid within the cassete 60 is advantageous in certain applications of the pumping system, it is contemplated that the intake tube 44 may be connected with a supply of fluid located externally of the cassette merely by an appropriate extension of the intake tube 44 to the exterior of the cassette housing.

It will be noted in FIGS. 4 and 5 that the front wall 72 of the cassette 60 is provided with an arcuate slot-like opening 124 to receive the capstan roller 22 when the cassette 60 is inserted into the well 64 of the console 62. In light of this arrangement it will be appreciated that with the pumping tube 10 supplied on the spool hub 16 and extending initially about the idler roller 24 to the spool hub 18, the pumping tube will not obstruct entry of the capstan roller 22 through the wall 72 so long as the capstan is in a retracted condition. Once the cassette is received in the well 64, the capstan 22 may be moved to its operative position as shown in FIG. 4 to pinch the pumping tube 10 against the cassette supported anvil roller 24. Operation in pumping is the same as that described above with respect to FIGS. 1 and 2.

Figure 9:
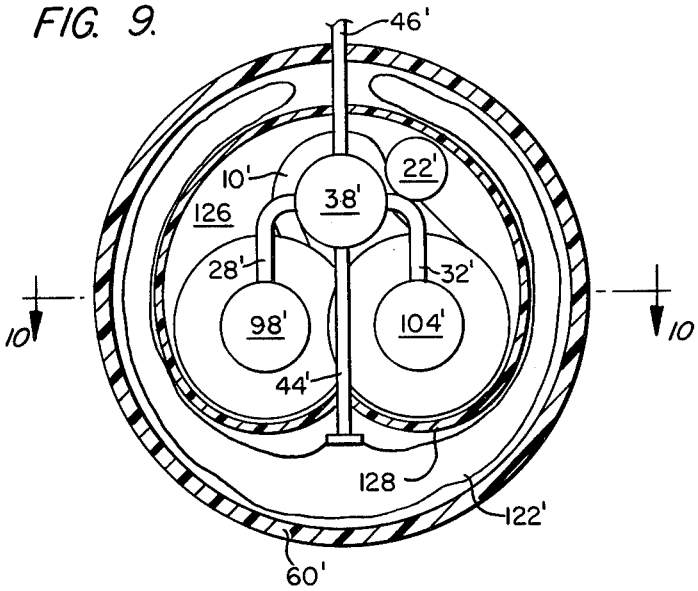
FIG. 9 is a cross-section illustrating an alternative embodiment of the present invention as seen on line 9—9 of FIG. 10.
Figure 10:
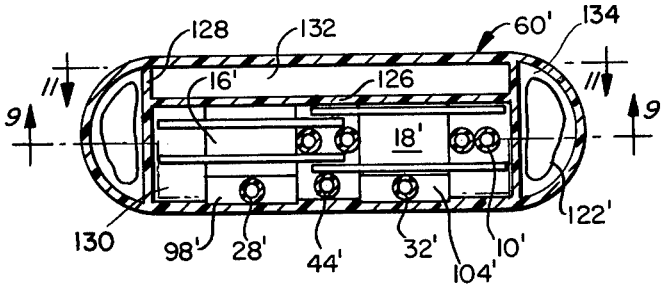
FIG. 10 is a cross-section on line 10—10 of FIG. 9.
Figure 11:
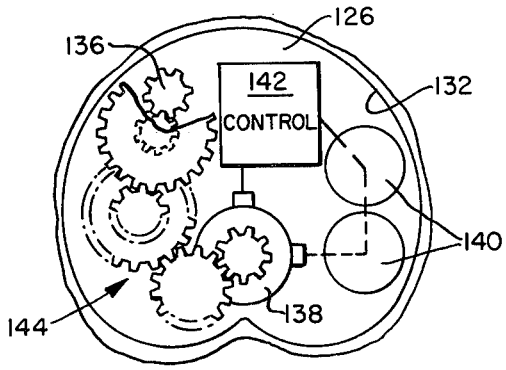
FIG. 11 is a fragmentary cross-section on line 11—11 of FIG. 10.

In FIGS. 9–11 of the drawings, an alternative embodiment of the invention is illustrated in which parts previously identified are designated by the same reference numerals but primed. In the embodiment of FIGS. 9–11, the pumping system is self-contained within a housing 60' designed to be implanted in an animal body for the administration of drugs or the like. The housing 60' is, therefore, of generally circular configuration in which the periphery thereof is of semi-toroidal configuration. The interior of the housing 60' is separated by internal walls 126 and 128 to define a pair of central chambers 130 and 132 circumscribed by an annular chamber 134. The chamber 130 encloses the operating components of the pumping system previously described as may be seen in FIGS. 9 and 10. The annular chamber 134 houses a flexible reservoir 122' adapted to receive a supply of the fluid or drug to be administered. The intake tube 44' extends to the flexible reservoir 122' as may be seen in FIG. 9. The discharge tube 46' extends as a catheter to the point of drug administration. While self-containment of the fluid supply in this way is desirable, it is contemplated that the intake tube 44' may extend to the exterior of the housing 60' to be in fluid communication with a separate external supply of fluid in the manner disclosed in U.S. Pat. No. 3,527,220.

The capstan 22' is journalled on a fixed axis from the internal wall 126 and extends through that wall to a gear 136 or equivalent located in the chamber 132 as may be seen in FIG. 11. Included with the gear 136 in the chamber 132 is a reversible electric motor 138 supplied with current from batteries 140 by a control module 142 also contained within the chamber 132. A reduction gear train 144 transmits power from the motor 138 to the capstan gear 136 as shown in FIG. 11. Suitable means as previously described would be provided to release the capstan 22' from pinching the tube 10' in order to accommodate refilling of the reservoir 122' by way of the tube 46'.

In some applications it is contemplated that the control 142 may be merely a torque responsive reversing control for the motor 138 to assure that the pumping tube 10 is driven in alternately opposite directions between the spool hub 16' and 18'. It is contemplated, however, that the control module 142 may include circuitry (not shown) by which the operation of the implanted pumping system may be operated under the control of external electromagnetic radiation developing means, electro-acoustical means, magnetic means or the like.

In light of the described embodiments, it will be appreciated that the pumping system of the present invention is adaptable to a variety of applications where accuracy of control over a continuously discharged fluid is needed. Because the rate of pumping is a function of the inside diameter of the pumping tube 10 and the velocity at which it is fed through the pitch roller pair 20, it is apparent that selection of pumping rates within a broad range may be determined by the particular diameter of the pumping tube employed and then regulating the speed of pumping tube travel by control over the speed of the capstan 22. The embodiment of FIGS. 3–5 is particularly suited to flow rate control due to the facility for providing multiple cassettes with varying sizes of the respective pumping tubes 10. A combination of selection of the appropriate cassette and then regulation of the capstan 22 will accommodate a very wide range of very accurately controlled discharge rates of a particular fluid. Such a system might incorporate the fluid within the cassette as described above but would be equally applicable to an external source of fluid where one need only select an appropriate cassette for the initial determination of pumping rate range. In this latter situation the cassette, in itself, represents a very inexpensive component containing only the pumping tube 10, the spools on which it is supplied, the switching valve, the idler roller 24, and the related fixed tubing. The expense involved in instrumentation required for fine control over the velocity at which the tube 10 moves through the pinch roller pair 20 is confined to the relatively permanent console 62.

Thus, it will be seen that as a result of the present invention, an extremely versatile and highly effective peristaltic pumping system is provided by which the principal object among others is completely fulfilled. It will be equally appreciated by those skilled in the art from the preceding description and accompanying drawings that many diverse modifications and/or variations may be made in the disclosed embodiments without departure from the invention. Accordingly, it is expressly intended that the foregoing description is illustrative only, not limiting, and that the true spirit and scope of the present invention be determined by reference to the appended claims.

What is claimed is:

1. A peristaltic pump comprising:

a pair of pinch rollers to define a nip;

a length of elastic tubing passing through said nip and being collapsed by said pinch rollers sufficiently to block passage fluid at said nip, said tubing having opposite ends;

selectively actuatable means for advancing said tubing in either one of two opposite directions through said nip;

means for defining a pump intake;

means for defining a pump discharge; and means for coupling one end of said tubing with said pump intake and the other end of said tubing with said pump discharge while said tubing is advanced through said nip in one direction and for coupling said one end with said pump discharge and said other end with said pump intake while said tubing is advanced through said nip in the other direction.

2. The apparatus recited in claim 1 wherein said coupling means includes valve means for alternately coupling opposite ends of said tubing to said pump intake and said pump discharge, respectively.

3. The apparatus recited in claim 2 including means for automatically alternating the coupling condition of said valve means in response to a reversal in the direction of tubing advance through said nip.

4. The apparatus recited in claim 3 wherein said means for automatically alternating the coupling condition of said valve means comprises means interconnecting said valve means and one of said pair of pinch rollers.

5. The apparatus recited in claim 4 wherein said valve means comprises rotatably shiftable means for alternating the coupling condition thereof, said means interconnecting said valve means and one of said pinch rollers comprising yieldable drag means between said rotatably shiftable means and said one of said pair of said pinch rollers.

6. The apparatus recited in claim 1 comprising a pair of rotatable spools to support opposite ends of said tubing and a housing for supporting said spools.

7. The apparatus recited in claim 6 wherein one of said pair of pinch rollers comprises an idler roller rotatably supported within said housing, the other of said pinch rollers comprising a drive capstan removably receivable in said housing to define said nip with said idler roller.

8. The apparatus recited in claim 6 including a supply of fluid to be pumped contained within said housing which defines a cassette-like enclosure.

9. A peristaltic pumping system comprising:

a housing to define a substantially enclosed chamber;

a pair of spools rotatably supported in said chamber;

a length of elastic tubing having opposite ends connected to said spools, respectively;

means for providing an adjustable valve in said chamber;

means in said housing for defining a pair of fixed conduits in fluid communication with said opposite ends of said elastic tubing, said conduits extending from said respective spools to said valve means;

means for defining a pump intake extending to said valve means and a pump discharge extending therefrom, said valve means being operative in one condition of adjustment to connect said pump intake with one of said fixed conduits and said pump discharge with the other of said fixed conduits, and in another condition of adjustment, to reverse the connection of said fixed conduits with said pump intake and said pump discharge;

a pair of pinch rollers adapted to close on said elastic tubing between said opposite ends, at least one of said pinch rollers being rotatably supported by said housing in said chamber;

means for rotatably driving said pinch rollers in either one of two opposite rotational directions in order to advance said elastic tubing through said pair of pinch rollers in either one of two opposite directions; and means for adjusting said valve between said conditions of adjustment in accordance with the direction of elastic tubing advance movement so that said pump discharge is in communication with that end of elastic tubing positioned upstream from said pinch rollers in relation to the direction of tubing advance through said pinch rollers.

10. The apparatus recited in claim 9 wherein said means for adjusting said valve means is reponsive to the rotational direction of said pinch rollers.

11. The apparatus recited in claim 9 wherein said one pinch roller supported by said housing is an idler anvil roller and the other of said pinch rollers is a drive capstan.

12. The apparatus recited in claim 11 wherein said housing is a cassette-like enclosure and wherein said apparatus further comprises a drive console having a well to removably receive said housing.

13. The apparatus recited in claim 12 wherein said drive capstan is supported in said well to extend within said housing and cooperate with said idling anvil roller.

14. The apparatus recited in claim 13 wherein said spools come through one face of said housing and there are also included drive spindle means in said well for rotatably engaging said spools.

15. The apparatus recited in claim 13 wherein said drive capstan is movable in a direction perpendicular to its axis between working and retracted positions.

16. A peristaltic pumping system comprising:

a cassette including an exterior housing for containing a length of elastic tubing, fluid passage means for connecting opposite ends of said tubing to a fluid intake and a fluid discharge, and an idler anvil roller engaging said tubing between said opposite ends; and a drive console for removably receiving said cassette and including a drive capstan roller adapted to extend within said cassette and cooperate with said anvil roller as one of a pinch roller pair to advance said tubing between said anvil roller and said capstan roller, said apparatus also including a pair of rotatable spools in said cassette, said cassette tubing being connected at opposite ends to said spools, respectively.

17. The apparatus recited in claim 16 wherein said fluid passage means comprises a reversing valve for alternating connection of opposite ends of said elastic tubing with said fluid intake and fluid discharge, respectively, in accordance with the direction of tubing advance.

* * * * *